United States Patent [19]

Johnson et al.

[11] 4,178,230

[45] Dec. 11, 1979

[54] PROCESS FOR THE SIMULTANEOUS PRODUCTION OF AROMATIC HYDROCARBONS AND ISOBUTANE

[75] Inventors: James A. Johnson, Clarendon Hills; Raouf G. Touma, Des Plaines, both of Ill.

[73] Assignee: UOP Inc., Des Plaines, Ill.

[21] Appl. No.: 908,300

[22] Filed: May 22, 1978

[51] Int. Cl.[2] ..... C10G 37/10; C07C 9/12

[52] U.S. Cl. ..... 208/66; 208/93; 585/310

[58] Field of Search ..... 208/66, 60, 93; 260/676 R

[56] References Cited

U.S. PATENT DOCUMENTS

| | | | |
|---|---|---|---|
| 3,719,586 | 3/1973 | Benner | 208/60 |
| 3,847,792 | 11/1974 | Berger | 208/60 |
| 3,950,241 | 4/1976 | Bonacci et al. | 208/93 |

*Primary Examiner*—Herbert Levine

*Attorney, Agent, or Firm*—James R. Hoatson, Jr.; John G. Cutts, Jr.; William H. Page, II

[57] ABSTRACT

A hydrocarbon charge stock boiling below 500° F. is converted into aromatic hydrocarbons and isobutane via a combination process involving catalytic reforming, hydrocracking and subsequent catalytic reforming without the immediate separation of the product effluent from the lead reformer and hydrocracking zone.

8 Claims, 1 Drawing Figure

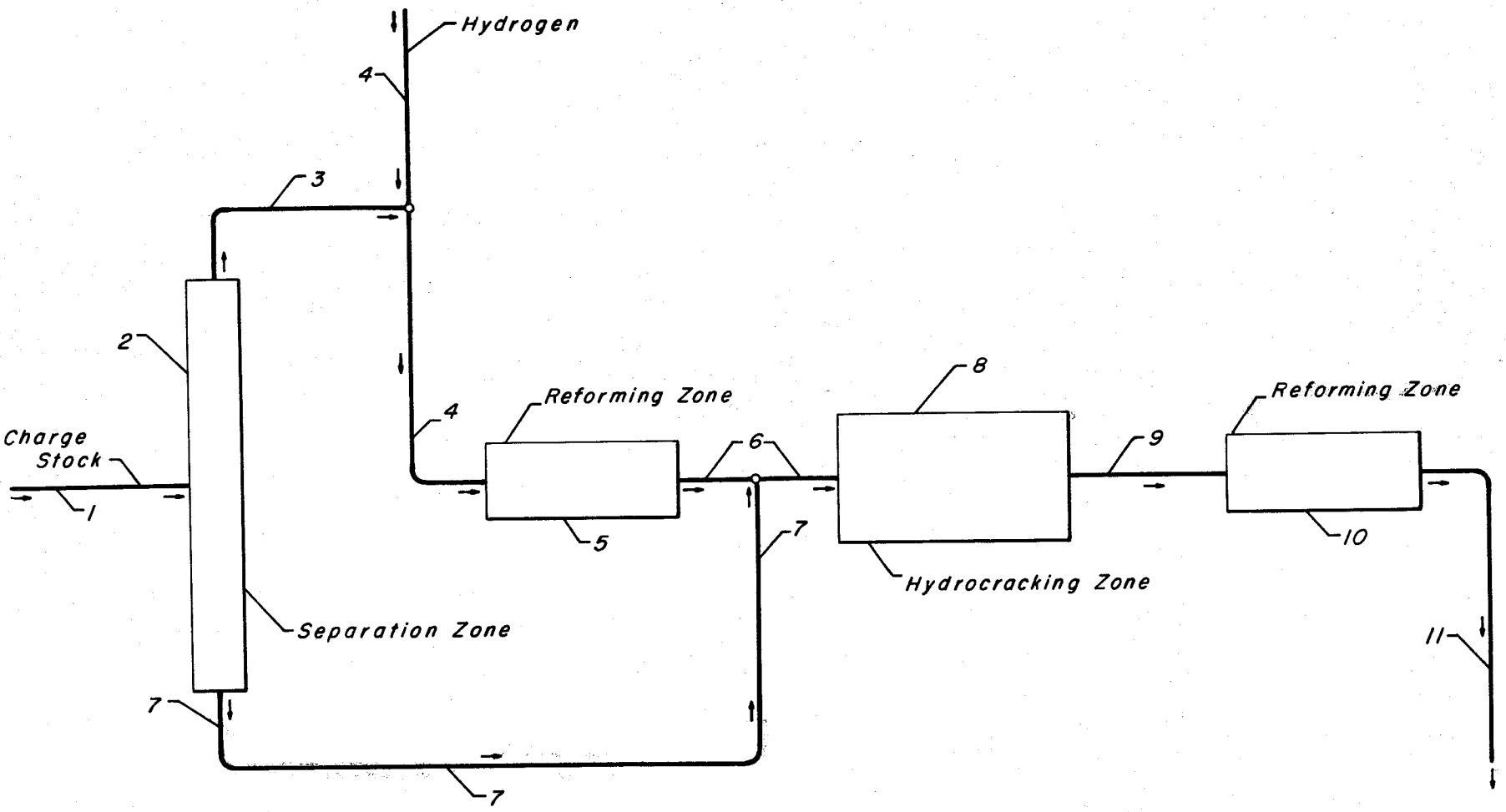
Hydrogen
4
3
4
Reforming Zone
5
6
7
Hydrocracking Zone
8
9
Reforming Zone
10
11
Separation Zone
2
7
7
Charge Stock
1

PROCESS FOR THE SIMULTANEOUS PRODUCTION OF AROMATIC HYDROCARBONS AND ISOBUTANE

APPLICABILITY OF INVENTION

The present invention involves a multiple stage process for the conversion of hydrocarbon charge stock boiling below about 500° F. to produce an aromatic hydrocarbon concentrate and exceedingly large quantities of isobutane.

Aromatic hydrocarbons, principally benzene, toluene, ethylbenzene and xylene isomers, are required in large quantities to satisfy an ever-increasing demand for various petrochemicals which are synthesized therefrom. For example, benzene may be hydrogenated to cyclohexane for use in the manufacture of nylon; toluene is often used as a solvent and as the starting material for various medicines, dyes, perfumes, etc. A principal utilization of aromatic hydrocarbons is as gasoline blending components in view of their exceedingly high research octane blending values. For example, benzene has a clear research octane blending value of 99, while toluene and all other aromatics have a value in excess of 100. Isobutane finds wide-spread use in organic synthesis, as a refrigerant and as an aerosol propellant, etc. Other uses include conversion to isobutenes for use in the production of butyl-rubber, copolymer resins with butadiene, acrylonitrile, etc. In accordance with one embodiment of the present invention, the multiple-stage process, for an aromatic concentrate and isobutane, is integrated into a refinery scheme for the production of a high octane, unleaded gasoline pool. The aromatic concentrate is sent directly to the unleaded gasoline pool while the isobutane concentrate is subjected to alkylation, with an olefinic hydrocarbon, the normally liquid alkylate product being recovered as a part of the gasoline pool.

Relatively recent investigations into the causes and cures of environmental pollution have shown that more than half of the violence to the atmosphere stems from vehicular exhaust consisting primarily of unburned hydrocarbons and carbon monoxide. These investigations have brought about the development of catalytic converters which, when installed within the automotive exhaust system, are capable of converting more than 90.0 percent of the noxious components into innocuous material. In developing these catalytic converters, it was learned that the efficiency of conversion and particularly the stability of the selected catalytic composite were severely impaired when the exhaust fumes resulted from the combustion of lead-containing fuels. Compared to operations of the catalytic converter during the combustion of clear, unleaded gasolines, both the conversion of noxious components and catalyst stability decreased as much as 50 percent when the motor fuel contained lead additives. Therefore, it has been recognized throughout the petroleum industry, as well as in the major gasoline-consuming countries, that suitable gasoline must be produced for consumption in current internal combustion engines without requiring the addition of lead to increase the octane rating. Also being recognized is the fact that unburned hydrocarbons and carbon monoxide are not the only extremely dangerous pollutants being discharged via vehicular exhaust. Japan has recently experienced an increase in the incidence of lead poisoning, and has enacted legislation to reduce significantly the quantity of lead in motor fuel gasolines.

One natural consequence of the removal of lead from motor fuel gasoline, in addition to many others, resides in the fact that petroleum refining operations will necessitate modification in order to produce voluminous quantities of high octane, unleaded motor fuels in an economically attractive fashion. One well-known and well-documented refining process, capable of significantly improving the octane rating of gasoline boiling range fractions, is the catalytic reforming process. In such a process, the primary octane-improving reactions are naphthene dehydrogenation, naphthene dehydroisomerization, paraffin dehydrocyclization and paraffin hydrocracking. Naphthene dehydrogenation is extremely rapid, and constitutes the principle octane-improving reaction. With respect to a 5-membered alkyl naphthene, it is necessary first to effect isomerization to produce a six-membered ring naphthene, followed by dehydrogenation to an aromatic hydrocarbon. Paraffin aromatization is achieved through dehydrocyclization of straight-chained paraffins; this reaction is rate limited in catalytic reforming operations. Unreacted, relatively low octane paraffins, therefore, are present in the catalytically reformed product effluent and effectively reduce the overall octane rating thereof. When operating at a relatively high severity, the paraffinic hydrocarbons within the reforming zone are subjected to cracking. While this partially increases the octane rating of the gasoline boiling range product, substantial quantities of normally gaseous material are produced. In view of the fact that hydrogen is present within the reaction zone, the light gaseous material is substantially completely saturated and comprises methane, ethane, propane and butane.

At a relatively low reforming severity, paraffin cracking is decreased with the result that an increased quantity of low octane rating saturates is produced. In order to upgrade the overall quality of the gasoline pool, either the addition of lead becomes necessary, or the low octane rating saturates must be subjected to further processing to produce higher octane components. As previously stated, subsequent processing of the saturates for octane rating improvement can be eliminated by increasing the operating severity within the catalytic reforming reaction zone. A high severity operation produces a two-fold effect while increasing the octane rating; first, additional high-octane aromatic components are produced and, secondly, the low octane rating components are at least partially eliminated by conversion either to aromatic components or light normally gaseous hydrocarbons. The results, therefore, include lower liquid yields of gasoline due both to "shrinkage" in molecular size when paraffins and naphthenes are converted to aromatics, and to the production of the aforesaid light gaseous components. These problems are further compounded when the desired end result is the production of a high octane, unleaded gasoline pool.

It has also been observed recently that a narrow boiling range motor fuel, consisting almost exclusively of $C_5$–$C_8$ hydrocarbons, with only minor quantities of $C_4$–$C_9$ (and heavier), would have certain advantages in reducing the emission of unburned hydrocarbons into the atmosphere. Currently marketed gasolines have a much broader boiling range, particularly with respect to the high-boiling end. One of the principal objects of my invention is to offer an efficient process for producing a highly desirable narrow-boiling range motor fuel. It is also being recognized that unburned hydrocarbons and carbon monoxide are not the only dangerous pollutants being discharged via vehicular exhaust. The possibility that lead compounds emitted in exhaust gases contributes to lead poisoning has resulted in appropriate legislation, enacted in some countries, to reduce significantly the quantity of lead permitted in motor fuel.

Problems spawned by the simultaneous production of aromatic hydrocarbons together with large quantities of isobutane are eliminated through the utilization of the present combination process. The application of the present process is by no means limited to the production of lead-free gasoline, aromatic hydrocarbon concentrate or large quantities of isobutane.

As hereinafter indicated in greater detail, the hydrocracking zone characteristically retains most of the rings present in the feed, albeit with fewer side carbon atoms. Thus, the integrity of the cyclic structure of alkyl aromatics can be largely preserved while producing isomeric paraffins from the side chain components. Of course, the extent of ring retention is a function of the extent of hydrocracking, so that a degree of freedom exists with regard to this aspect of the invention.

Hydrocarbonaceous charge stocks, contemplated for conversion in accordance with the present invention constitute hydrocarbons boiling below about 500° F. at atmospheric pressure. Preferred charge stocks include gasoline boiling range hydrocarbons.

"Gasoline boiling range hydrocarbons" generally connotes those hydrocarbons, usually devoid of pentane and lighter material, having an initial boiling point of at least about 100° F. and having a final boiling point of at least about 450° F., and is inclusive of intermediate boiling range fractions often referred to in the art as "light naphtha" and "heavy naphtha." However, it is not intended to limit the present invention to a charge stock having the characteristics of gasoline boiling range hydrocarbons. Suffice to say, a suitable charge stock will generally have an initial boiling point above about 100° F. and an end boiling point below about 500° F. During the selective hydrocracking step the charge stock is reduced in boiling range. The precise boiling range of any given naphtha fraction will be dependent upon the economic and processing considerations which are prevalent in the particular locale where such a charge stock is available. The key feature of the present invention resides in a combination of hydrocracking and catalytic reforming in which higher molecular weight paraffins are cracked into more highly branched, lower boiling material and the ring structure of both naphthenes and aromatics is largely preserved so that the catalytic reforming operation will result in exceptional product quality and volumetric yield.

PRIOR ART

It must be acknowledged that the prior art contains references to the hydrocracking of hydrocarbon fractions followed by the catalytic reforming of a portion of the hydrocracked product effluent. Others have utilized a compatible catalyst system in which the operating conditions of pressure, hydrogen recycle and contaminant level are such that a true series-flow from hydrocracking to catalytic reforming is afforded. That is, the combination may be maintained in a completely integrated fashion without the necessity for the separation of gaseous and/or liquid phases intermediate the two systems.

OBJECTS AND EMBODIMENTS

A principal object of the present invention is the simultaneous production of aromatic hydrocarbons and an isobutane concentrate. A corollary objective resides in the production of a high-octane, unleaded motor fuel gasoline pool.

Therefore, in one embodiment, the present invention affords a process for the simultaneous production of an aromatic concentrate and an isobutane concentrate, from a charge stock boiling below about 500° F. which comprises the steps of: (a) separating said charge stock, in a first separation zone, to provide a first fraction having an end boiling point in the range of about 300° F. to about 400° F., and a second fraction having an initial boiling point in the range of about 300° F. to about 400° F. and an end boiling point greater than about 410° F.; (b) reacting said first fraction, with hydrogen, in a first reaction zone, in contact with a first catalytic composite comprising platinum and alumina, at a temperature in the range of about 800° F. to about 1100° F. and pressure of from about 100 to about 400 psig., said temperature and pressure selected to convert at least a portion of said naphthenes to aromatic hydrocarbons; (c) reacting the resulting first reaction zone effluent without intermediate separation thereof, together with said second fraction from step (a), in a second reaction zone, in contact with a second catalytic composite of a Group VIII noble metal component and a zeolitic aluminosilicate carrier material and at a temperature in the range of about 350° F. to about 800° F. and a pressure from about 100 to about 400 psig.; (d) reacting the resulting second reaction zone effluent without intermediate separation thereof, in a third reaction zone, in contact with a third catalytic composite comprising platinum and alumina, at a temperature in the range of about 800° F. to about 1100° F. and a pressure of from about 100 to about 400 psig.; and, (e) recovering said isobutane concentrate from the resulting third reaction zone effluent.

In another embodiment, the present invention affords a process for the simultaneous production of an aromatic concentrate and an isobutane concentrate, from a charge stock boiling below about 500° F., and containing a high percentage of naphthene hydrocarbon components which comprises the steps of: (a) separating said charge stock, in a first separation zone, to provide a first fraction having an end boiling point in the range of about 300° F. to about 400° F., and a second fraction having an initial boiling point in the range of about 300° F. to about 400° F. and an end boiling point greater than about 410° F.; (b) reacting said first fraction, with hydrogen, in a first reaction zone, in contact with a first catalytic composite comprising platinum and alumina, at a temperature in the range of about 800° F. to about 1100° F. and pressure of from about 100 to about 400 psig., said temperature and pressure selected to convert at least a portion of said naphthenes to aromatic hydrocarbons; (c) reacting the resulting first reaction zone effluent without intermediate separation thereof, together with said second fraction from step (a), in a second reaction zone, in contact with a second catalytic composite of a Group VIII noble metal component and a zeolitic aluminosilicate carrier material and at a temperature in the range of about 350° F. to about 800° F. and a pressure from about 100 to about 400 psig.; (d) reacting the resulting second reaction zone effluent without intermediate separation thereof, in a third reaction zone, in contact with a third catalytic composite comprising platinum and alumina, at a temperature in the range of about 800° F. to about 1100° F. and a pressure of from about 100 to about 400 psig.; and, (e) recovering said isobutane concentrate from the resulting third reaction zone effluent.

Other embodiments of our invention involve the use of various catalytic composites, operating conditions and processing techniques.

SUMMARY OF INVENTION

As hereinabove set forth, the present invention constitutes a combination process for the simultaneous production of an aromatic concentrate and an isobutane concentrate from a hydrocarbon charge stock boiling below about 500° F. One of the key features of this combination process is the initial separation of the feedstock into two portions. The first portion having an end boiling point in the range of about 300° F. to about 400° F., and the second portion having an initial boiling point in the range of about 300° F. to about 400° F. and an end boiling point greater than about 410° F. Another of the key features of this combination process is a true series-flow system from a reforming zone through a hydrocracking zone and then subsequently through another reforming zone. The hydrocarbon feedstocks travel through each successive zone without any intermediate separation thereof.

The charge stock boiling below about 500° F. may be obtained from a multitude of sources. For example, one suitable source constitutes the naphtha/light-kerosene cut from a full boiling range petroleum crude oil; another source is the fraction boiling below about 500° F. obtained from the catalytic cracking of gas oil, while still another source constitutes the fraction boiling below about 500° F. from a hydrocracking reaction zone which processes gas oil charge stocks. In view of the fact that many potential charge stocks are contaminated through the inclusion of sulfurous and nitrogeneous compounds, as well as olefinic hydrocarbons, it is contemplated that such contaminants will be removed by conventional hydrorefining before the charge stock is supplied to the first reforming zone. Details of hydrorefining processes are well known and thoroughly described in the prior art. It is understood that such pretreatment of the selected charge stock is not a novel feature of the present combination process.

Especially suitable feedstocks for the present invention are those boiling below about 500° F. and which contain from about 14 to about 65 volume percent naphthene hydrocarbons. Our invention is particularly adept at processing feedstocks which have a naphthene hydrocarbon content in the range of about 35 to about 65 volume percent.

Catalytic composites, suitable for utilization in the reforming reaction zone, generally comprise a refractory inorganic oxide carrier material containing a metallic component selected from the noble metals of Group VIII. Recent developments in the area of catalytic reforming have indicated that catalyst activity and stability are significantly enhanced through the addition of various modifiers, and especially tin, rhenium, nickel, and/or germanium. Suitable porous carrier materials include the amorphous refractory inorganic oxides such as alumina, silica, zirconia, etc., and various crystalline aluminosilicates or combinations of alumina and/or silica with the various crystalline aluminosilicates. Generally favored metallic components include ruthenium, rhodium, palladium, osmium, rhenium, platinum, iridium, germanium, nickel, tin, and mixtures thereof. A preferred catalytic composite constitutes alumina and a platinum component in a concentration ranging from about 0.01 percent to about 5 percent by weight, and preferably from about 0.01 percent to about 2 percent by weight, calculated as the elemental metal. Reforming catalysts, suitable for utilization in the present combination process, may also contain combined halogen selected from the group of chlorine, fluorine, bromine, iodine and mixtures thereof.

Effective reforming operating conditions include catalyst temperatures within the range of about 800° F. to about 1100° F., preferably having an upper limit of about 1050° F. The liquid hourly space velocity, defined as volumes of hydrocarbon charge per hour per volume of catalyst disposed within the reforming reaction zones, is preferably within the range of about 1 to about 25, although space velocities from about 0.5 to about 50 may be employed. The quantity of hydrogen-rich gas, in admixture with the hydrocarbon feedstock, is generally from about 1 to about 20 moles of hydrogen per mole of normally liquid hydrocarbons. Pressures in the range of about 100 to about 400 psig. are suitable for effecting catalytic reforming reactions. However, since the present combination process is effected in true series-flow fashion, the first reforming zone pressure will be somewhat more than the hydrocracking zone pressure and the second reforming zone pressure will be somewhat less than that imposed upon the hydrocracking reaction zone, allowing for the pressure drop normally experienced as a result of fluid flow through the system, or at some intentionally reduced pressure level, i.e., from about 100 to about 300 psig.

The prior art teaches a process for high octane motor fuel production utilizing hydrocracking followed by catalytic reforming without the intermediate separation of the product effluent from the hydrocracking zone. However, a problem is created when the selected feedstock contains a large quantity of naphthenic hydrocarbons and is charged to the prior art process. When the naphthene hydrocarbons are exposed to the prior art hydrocracking zone, the rapid endothermic dehydrogenation of the naphthene aromatics produces a drastic reduction in the temperature of the catalyst bed and the flowing reactants. The resulting depressed temperature of the reactants prevents the desired hydrocracking reactions to occur and thereby defeating the objective of the hydrocracking zone. Also when a hydrocarbon charge with an end point greater than about 375° F. is exposed to reforming catalyst, an accelerated deactivation rate of the reforming catalyst is observed. Since the simultaneous production of aromatic hydrocarbons and isobutane is maximized utilizing a feedstock boiling below about 500° F. and containing a high percentage of naphthenes, we have discovered that if the fresh feedstock boiling below about 500° F. and containing a high percentage of naphthenes is first separated into a first fraction having an end boiling point in the range of about 300° F. to about 400° F., and a second fraction having an initial boiling point in the range of about 300° F. to about 400° F. and an end boiling point greater than about 410° F., the first fraction is reacted in a reforming zone to convert at least a portion of the naphthenes, and the second fraction, together with the resulting reformed first fraction is reacted in a subsequent reforming zone, the feedstock will yield the desired isobutane and aromatic hydrocarbons. The preferred naphthene conversion in the initial reforming zone placed before the hydrocracking zone is from about 25% to about 90% of the available naphthenes. More preferably, the naphthene conversion is from about 35% to about 80% of the available naphthenes.

The second reforming reaction zone effluent is introduced into a high-pressure separation system at a temperature of about 60° F. to about 140° F., to separate lighter components from heavier, normally liquid components. Since normal reforming operations produce large quantities of hydrogen, a certain amount of a gaseous stream rich in hydrogen is removed from the reforming zoned system by way of pressure control. The remaining hydrogen-rich gaseous phase may be recycled to combine with the charge to the first reforming reaction zone.

The hydrocracking reaction zone receives the effluent from the first reforming zone together with a fraction of the feedstock having an initial boiling point in the range of about 300° F. to about 400° F. and an end boiling point greater than about 410° F. for selective hydrocracking and produces a hydrocracked effluent containing very little normally gaseous hydrocarbon material such as methane and ethane. In the event that net hydrogen production is to be recycled within the process, the normally gaseous material present in any recycled hydrogen rich vaporous phase will, of course, be present in the effluent. Through the utilization of a particular catalytic composite and operating conditions, the integrity of cyclic hydrocarbon rings is largely maintained, and the cracking of paraffinic hydrocarbons results primarily in low molecular weight isoparaffins.

The separation zone utilized to prepare the particular fractions of feedstock in the present invention may include any of the well known operations to separate hydrocarbons such as fractionation, crystallization, crystalline aluminosilicate adsorption-desorption, distillation, etc.

The selective nature of the hydrocracking reaction taking place include the retention of cyclic rings and the reduction in molecular weight thereof, via isomerization and the splitting of isoparaffins from the parent molecule. Thus, cyclic compounds boiling in the higher temperature range of the feedstock are converted to lower-boiling naphthenes and aromatics. In the subsequent catalytic reforming reaction zone, the available remaining naphthenes are dehydrogenated into gasoline boiling range aromatics while the aromatic hydrocarbons in the hydrocracked product effluent are retained intact.

The conversion conditions employed in the hydrocracking reaction zone include a liquid hourly space velocity of about 0.5 to about 20, preferably having an upper limit of about 10, a hydrogen circulation of from about 1 to about 20 moles per mole of feed, a pressure of from about 100 to about 400 psig. and, of greater significance, a maximum catalyst bed temperature in the range of about 350° to about 850° F.

The catalytic composite disposed in the hydrocracking reaction zone of the present combination process comprises a Group VIII noble metal component combined with a porous carrier material, either amorphous, or zeolitic in nature, and preferably siliceous; a particularly preferred carrier material comprises the crystalline alumino-silicate generally known as mordenite. Suitable carrier materials may be selected from the group of amorphous refractory inorganic oxides including alumina, silica, titania, zirconia, mixtures thereof, etc., or from zeolitic, aluminosilicate materials such as faujasite, mordenite, Type A or Type U molecular sieves, or zeolitic material which is combined with an amorphous matrix. As above-noted, a Group VIII noble metal component comprises an element of hydrocracking catalyst. Suitable metals are those from the group of platinum, palladium, rhodium, ruthenium, osmium and iridium, as well as mixtures thereof. Of these, a palladium, or platinum component is especially preferred in view of the increased propensity to maintain the cyclic structure. The noble metal will be combined with the carrier material in an amount of about 0.01 percent to about 2.0 percent by weight, calculated as the elemental metal. Mordenite, the preferred carrier material, from the standpoint of converting normal paraffins into the isomeric counterparts, may be employed in and of itself; generally, however, the carrier material is amorphous alumina with the mordenite being in the range of about 1.0 percent to about 75.0 percent. The utilization of this specific reforming/hydrocracking/reforming combination permits the reforming zone to function at relatively low-severity conditions.

As hereinabove set forth, the catalytic composite disposed within the hydrocracking reaction zone utilizes a mordenite-containing carrier material for a palladium, or platinum component. Mordenite is a highly siliceous zeolitic crystalline aluminosilicate which, as naturally-occurring, or synthetically-prepared, has a silica to alumina mole ratio in the range of about 6 to about 12. The crystalline structure of mordenite consists of four- and five-membered rings of silicon and aluminum tetrahedra arranged to form channels, or tubes running parallel to the axis of the crystal. Being parallel, these channels do not intersect with the result that they may be entered only at the ends thereof. Such a channel-type structure is unique to mordenite among the many zeolites, and the mordenite structure is often termed "two-dimensional" in contrast to other zeolitic materials, such as faujasite, in which the cages may be entered from three directions. The conventional silicon to aluminum mole ratio of 6 to about 12 may be increased to as high as 50 or more by acid-leaching alumina from the mordenite, while simultaneously preserving the characteristic mordenite crystal structure. Although substantially pure mordenite may be employed in the carrier material for the hydrocracking reaction zone, the preferred technique utilizes a mordenite crystal structure contained in amorphous alumina which is fixed in combination therewith in an amount in the range of about 25.0 percent to about 99.0 percent by weight.

The hydrocracking catalytic composite is prepared by initially forming the mordenite component having a silica/alumina mole ratio of about 12 to about 30, and preferably from about 15 to about 25. This is in contrast to conventional mordenite which commonly has a silica to alumina mole ratio in the range of about 6 to about 12. An amorphous silica-alumina composite is utilized as the starting material, and one particularly suitable source thereof is amorphous cracking catalyst containing about 13 percent by weight of alumina. The mordenite is typically manufactured by a process involving several steps, one of which is the formation of an acidic silica sol via the acidification of an aqueous sodium silicate solution. Other steps in the manufacture of the cracking catalyst include gelation of the silica gel, subsequent adjustment of the pH of the resulting slurry to about 3.5, followed by impregnation with an alumina sol using an aqueous aluminum sulfate solution. The aluminum sulfate is thereafter hydrolyzed and precipitated. The silica-alumina product from the above steps is slurried with water and spray dried to yield fine silica-alumina microspheres suitable as the starting material for the manufacture of the mordenite component of the catalyst employed in the combination process of the present invention.

Regardless of the origin of the amorphous silica-alumina starting material, the same is heated in the admixture with an aqueous alkali metal solution, for example, sodium hydroxide, at a temperature in the range of about 275° F. to about 480° F. The solution has an alkali metal concentration sufficient to provide an alkali metal/aluminum weight ratio from about 1.5 to about 3.5 within the reaction mixture. Yields of zeolites in the range of 90.0 percent to about 100.0 percent may be obtained after the stirred reaction mixture has been heated for a period from about 8 to about 24 hours. The resulting zeolite has a silica/alumina mole ratio substantially the same as the amorphous silica-alumina starting material.

Although it is understood that no precise method of manufacturing the mordenite component is essential to my invention, it is preferred to convert the resulting sodium form to the hydrogen form by conventional ion-exchange techniques. Conversion of the sodium form to the hydrogen form is achieved either by the direct replacement of sodium ions with hydrogen ions, or by the replacement of sodium ions with ammonium ions, followed by decomposition of the ammonium form by way of calcination at an elevated temperature. At least about 95.0 percent, and preferably at least about 99.0 percent of the alkali metal is removed by the ion-exchange technique.

The noble metal component, and especially palladium, or platinum may be incorporated within the catalytic composite in any suitable manner including ion-exchange or impregnation. The latter constitutes a preferred method, and utilizes water-soluble compounds of the noble metal component. Thus, the mordenite-containing carrier material may be impregnated with an aqueous solution of ammonium chloropalladate, chloropalladic acid, palladic chloride, hydrated palladium nitrate or the corresponding platinum compounds, etc. Following impregnation, the carrier material is dried at a temperature in the range of about 200° F. to about 400° F., and subsequently subjected to a calcination, or oxidation technique at an elevated temperature in the range of about 900° F. to about 1200° F.

Prior to its use, the catalytic composite may be subjected to a substantially water-free reduction technique. This is designed to insure a more uniform and thorough dispersion of the metallic components throughout the carrier material. Substantially pure and dry hydrogen is employed as the reducing agent at a temperature of about 800° F. to about 1200° F., and for a time sufficient to reduce the metallic component. In the present specification, as well as the appended claims, the use of the term Group VIII noble metal component is employed generically to encompass the existence of the metal in the elemental state, or in some combined form such as an oxide, sulfide, chloride, etc.

BRIEF DESCRIPTION OF THE DRAWING

The drawing shows a schematic flow diagram of a typical process embodying this invention.

DETAILED DESCRIPTION OF THE DRAWING

The inventive concept, encompassed by the present process, is illustrated in the accompanying drawing. Miscellaneous appurtenances, not believed necessary for a completely clear understanding of the present combination process, have been eliminated. The use of details such as pumps, compressors, instrumentation and controls, heat-recovery circuits, miscellaneous valving, start-up lines and similar hardware, etc., is well within the purview of those skilled in the petroleum refining art. Similarly, with respect to the flow of materials throughout the system, only those major streams required to illustrate the interconnection and interaction of the reaction zones are presented. Thus, recycle lines, quench streams, and vent gas streams have also been eliminated.

With reference now to the drawing, it will be described in conjunction with a commercially scaled unit designed to process a hydrocarbon feedstock having a boiling end point of 418° F. which has previously been subjected to a hydrorefining technique for desulfurization, denitrification and olefin saturation. Pertinent properties of this feedstock are presented in the following Table I:

TABLE I

| Feedstock Properties | |
|---|---|
| API Gravity, ° | 51.8 |
| 100 ml. Distillation, °F. | |
| I.B.P. | 246 |
| 10 | 268 |
| 30 | 288 |
| 50 | 318 |
| 70 | 348 |
| 90 | 388 |
| End Point | 418 |
| Hydrocarbon Type, vol. % | |
| Paraffins | 48.5 |
| Naphthenes | 41.4 |
| Aromatics | 10.1 |

Apparent to those having skill in the art of catalytic reforming, is the fact that this charge stock constitutes a suitable feedstock only for reforming systems which are operated in a low severity mode. However, normally conducted catalytic reforming, or those variants which practice selective cracking of the reformed product effluent, result in a final product containing substantial amounts of $C_9$, $C_{10}$ and $C_{11}$ aromatic hydrocarbon compounds, resulting in ASTM distillation end points in excess of 400° F. Although this constitutes a suitable motor fuel gasoline, it will not have the more narrow boiling range characteristics made possible through the use of the present invention and required by todays more sophisticated motor fuel requirements.

The charge stock is introduced into separation zone 2 via line 1. A first hydrocarbon fraction is removed from separation zone 2 via line 3 and a second hydrocarbon fraction is remoed from separation zone via line 7. Hydrogen is introduced via line 4 and the first hydrocarbon fraction passing via line 3 passes into line 4. Hydrogen and the first hydrocarbon fraction are passed via line 4 into reforming zone 5 and heated to reforming conditions selected to dehydrogenate approximately 75% of the available naphthenes contained in the feedstock which conditions include a liquid hourly space velocity of about 20 $hr.^{-1}$, a hydrogen to charge stock mole ratio of about 6, a pressure of about 260 psig., and a temperature of about 900° F. The catalytic composite disposed in reforming zone 5 constitutes an alumina carrier material containing 0.6 wt. % platinum and 0.6 wt. % rhenium which catalyst is a wellknown commercially available reforming catalyst.

The effluent from reforming zone 5 is passed via line 6 into hydrocracking zone 8 and the second hydrocarbon fraction passing via line 7 passes into line 6. The effluent from reforming zone 5 and the second hydrocarbon fraction are processed in hydrocracking zone 8 without intermediate separation thereof at a temperature of about 760° F., a liquid hourly space velocity of about 5, a hydrogen to charge stock mole ratio of about 5, and a pressure of about 250 psig. The catalytic composite disposed in hydrocracking zone 8 constitutes an alumina-mordenite carrier material containing about 0.75 percent by weight of a palladium component, calculated as the elemental metal.

The total effluent from hydrocracking zone 8 is passed via line 9 into reforming zone 10 and is processed without intermediate separation thereof at a temperature of 960° F., a pressure of about 240 psig., a liquid hourly space velocity of about 2 $hr.^{-1}$ and a hydrogen to hydrocarbon mole of about 5. The hydrogen to hydrocarbon mole ratio has been diminished as a result of the hydrogen consumed in hydrocracking zone 8. The catalyst incorporated in reforming zone 10 is the same type as described hereinabove for reforming zone 5.

Catalytic reforming zones 5 and 10 are represented as a single figure but each may in fact be a plurality of reaction zones wherein the endothermic nature of the reactions is compensated via interheating between zones.

The product effluent from reforming zone 10 is removed via line 11 and recovered. Recovery of the product from the process of the invention may be performed by any of the well-known refinery operations such as separation, fractionation, compression, refrigeration, condensation, etc. Properties and yields of the product based on fresh feed charge stock to separation zone 2 are presented in the following Table II:

TABLE II

Product Yields and Properties

| Component | Wt. % | Liquid Vol. % (F.F.) |
|---|---|---|
| Hydrogen | 0.90 | |
| Methane/Ethane | 1.15 | |
| Propane | 6.31 | |
| Isobutane | 9.60 | 12.99 |
| N-butane | 4.95 | 6.45 |
| Isopentane | 6.54 | 7.97 |
| N-pentane | 3.56 | 4.30 |
| Hexane-plus | 66.99 | 64.49 |
| | 100.00 | |
| **Properties of Pentane-Plus** | | |
| Specific Gravity | | 50.7 |
| Research Octane Rating | | 97.6 |
| Distillation, °F. | | |
| I.B.P. | | 110 |
| 30% | | 192 |
| 50% | | 240 |
| 70% | | 282 |
| 90% | | 342 |
| End Point | | 442 |

The mixed butanes can be partially dehydrogenated to produce butylenes which may be subsequently alkylated with unconverted isobutanes to produce a $C_4$-alkylate of known octane rating. Similarly, the propane may be utilized as a starting material for isopropyl alcohol, or may also be subjected to dehydrogenation and alkylation to produce a $C_3$-alkylate of good octane rating.

This example illustrates the application of the concept of the present combination to certain specific compatible catalysts in the hydrocracking and catalytic reforming zones. However, in a broad sense, the inventive concept is applicable to other hydrocracking and reforming catalysts provided they are compatible, i.e., they can function in a low-pressure, series-flow fashion with substantially the same catalytic reaction atmosphere prevailing in all reaction zones and without separation of components between zones.

In presenting this hereinabove example, it is not intended that the invention be limited to the specific illustrations, nor is it intended that a given process be limited to the particular operating conditions, catalytic composite, processing techniques, charge stock, etc. It is understood, therefore, that the present invention is merely illustrated by the specifics set forth.

The foregoing illustrates the method by which the present combination is effected and the benefits afforded through the utilization thereof.

We claim as our invention:

1. A process for the simultaneous production of an aromatic concentrate and an isobutane concentrate from a hydrocarbon charge stock boiling below about 500° F., and containing from about 14 to about 65 volume % naphthene hydrocarbon components which comprises the steps of:

(a) separating said charge stock into two fractions in a separation zone to provide a first fraction processing an end boiling point in the range of about 300° F. to about 400° F., and a second fraction having an initial boiling point in the range of 300° F. to 400° F. and an end boiling point not greater than 410° F.;

(b) reacting said first fraction, with hydrogen, in a first reforming reaction zone, in contact with a first catalytic composite comprising platinum and alumina at a temperature in the range of about 800° F. to about 1100° F. and a pressure of from about 100 to about 400 psig, said temperature and pressure selected to convert from about 25 volume % to about 90 volume % of said about 14 volume % to about 65 volume % naphthene hydrocarbon components to aromatic hydrocarbons within the first reforming zone effluent stream;

(c) admixing said first reforming zone effluent stream, without intermediate separation of the same to remove $C_4-$ light ends therefrom, with said second fraction processing an end boiling point of not greater than 410° F., in a hydrocracking reaction zone to hydrocrack both of said fractions, in contact with a second catalytic composite comprising a Group VIII noble metal component and a zeolitic aluminosilicate carrier material at a temperature in the range of about 350° F. to about 800° F. and a pressure from about 100 to about 400 psig, to produce a hydrocracking reaction zone effluent;

(d) reacting said hydrocracking reaction zone effluent, without intermediate separation of the same to remove $C_4-$ light ends therefrom, in a second reforming reaction zone in contact with a third catalytic composite comprising platinum and alumina, at a temperature in the range of about 800° F. to about 1100° F. and a pressure of from about 100 to about 400 psig to produce a second reforming reaction zone effluent stream; and (e) recovering said isobutane concentrate from said second reforming reaction zone effluent stream.

2. The process of claim 1 wherein said second catalytic composite contains a palladium component, in an amount of 0.01 to about 2 percent by weight, calculated as the elemental metal.

3. The process of claim 1 wherein said second catalytic composite contains a platinum component, in an amount of 0.01 to about 2 percent by weight, calculated as the elemental metal.

4. The process of claim 1 wherein said carrier material comprises mordenite.

5. The process of claim 4 wherein said mordenite has a silica to alumina mole ratio from 12 to about 30.

6. The process of claim 1 further characterized in that said carrier material comprises mordenite distributed within an amorphous alumina matrix.

7. The process of claim 1 wherein said charge stock contains at least about 20 volume percent naphthenes.

8. The process of claim 1 wherein at least about 40 volume percent of the available naphthene components in the fresh feed are converted to aromatic hydrocarbons in said first reaction zone.

* * * * *